US005369840A

United States Patent [19]

Salvador et al.

[11] Patent Number: 5,369,840

[45] Date of Patent: Dec. 6, 1994

[54] STOP MECHANISM FOR A DOOR

[76] Inventors: Wayne J. Salvador; Julie L. Salvador, both of 460 D. Street, Fremont, Calif. 94536

[21] Appl. No.: 65,946

[22] Filed: May 24, 1993

[51] Int. Cl.[5] ..... E05F 5/02

[52] U.S. Cl. ..... 16/82

[58] Field of Search ..... 16/82, 83, 86 R, 86 B, 16/86 A, 86 C; 292/DIG. 15

[56] References Cited

U.S. PATENT DOCUMENTS

| | | | |
|---|---|---|---|
| 1,117,253 | 11/1914 | Sargent et al. | 16/83 |
| 1,354,079 | 9/1920 | Tate et al. | 16/83 |
| 1,510,873 | 10/1924 | Tate | 16/83 |
| 1,649,339 | 11/1927 | Conley | 16/83 |
| 2,175,403 | 10/1939 | Larson | 16/83 |
| 3,639,943 | 2/1972 | Cadiou | 16/82 |
| 4,368,555 | 1/1983 | Salerno | 16/83 |
| 4,782,553 | 11/1988 | Morrison | 16/86 A |
| 4,811,454 | 3/1989 | Crook et al. | 16/82 |

FOREIGN PATENT DOCUMENTS

| | | | |
|---|---|---|---|
| 2258270A | 2/1993 | United Kingdom | 16/82 |

*Primary Examiner*—P. Austin Bradley
*Assistant Examiner*—Chuck Y. Mah
*Attorney, Agent, or Firm*—Bielen, Peterson & Lampe

[57] ABSTRACT

A stop mechanism for a door associated with a jamb utilizing an arresting element. The arresting element is capable of withstanding force asserted on an object normally positioned between the door and the jamb. In addition, the arresting element is sized to provide a gap between the door and the jamb when the door is swung toward a closed position. A tether is also employed in the present invention which is connected to the arresting element, and permits the arresting element to lie in a first position in the vicinity of the closed door and associated jamb and in a second position between the door and the jamb when the door is again motivated toward closing. The tether is supported to the vicinity of the door jamb at a selected level above the ground surface.

7 Claims, 2 Drawing Sheets

STOP MECHANISM FOR A DOOR

BACKGROUND OF THE INVENTION

The present invention relates to a novel stop mechanism for a door associated with a jamb.

Many items have been developed to prevent doors from opening or closing. The typical door stop includes a weighted item which is normally placed on the floor in the vicinity of the door such that the door cannot travel, normally along a rotational path. For example, U.S. Pat. Des. Nos. 286,015 and 302,939 describe doorstops which are free standing.

Other door stops have been devised that are connected to door and prevent movement of the door by simply serving as an extension of the dimension of the door. For example, U.S. Pat. No. 4,782,553 depicts this type of door stop.

U.S. Pat. No. 3,639,943 shows a door stop which has a hinge pin parallel to the door hinge pin and carries a movable finger which connects with a catch to lock a car door or folded into immediate position between the open and closed position.

A door stop mechanism which is simple to use, versatile, and effective would be a great advance in the building art field.

SUMMARY OF THE INVENTION

In accordance with the present invention a novel and useful door stop mechanism is herein described.

The mechanism of the present invention utilizes an arresting element capable of withstanding force asserted on an object positioned between a closing door and a jamb. The arresting element may be constructed of a relatively rigid core member surrounded by a force absorbing cover, which may be constructed of resilient material.

The present mechanism also includes a tether which is connected to the arresting element. The tether is capable of holding the arresting element in a first position in the vicinity of a closed door associated with a jamb. In this position the tether and connected arresting element permits the opening of the door, since the arresting element may be pushed aside by the opening door. Moreover, an attempt to reclose the door is interrupted by the arresting element which is capable of assuming a second position between the door and the jamb. The tether may be a resilient line, a tape, and the like. A reel may also be used to retract or pay out the tether when positioning the arresting element adjacent the door and the jamb. In addition, an audio or visual element may be associated with the arresting element to signal door movement.

Support means is also included in the present invention for mounting the tether and the arresting element to the vicinity of the door jamb. The support means may be formed of removably detachable fasteners such as Velcro, snaps, and the like.

It may be apparent that a novel and useful stop mechanism for a door has been described.

It is therefore and object of the present invention to provide a stop mechanism which is simple to operate and efficiently prevents the closing of a door associated with a jamb, and is easily reset allowing a door to close.

Another object of the present invention is to provide a stop mechanism for a door which obviates unsafe and injurious conditions associated with a door, especially with respect to children.

Another object of the present invention is to provide a stop mechanism for a door which is capable of easily being installed and removed from conventional doors associated with jambs and is commensurate with the height of the users thereof.

Yet another object of the present invention is to provide a stop mechanism for a door which is durable and reliable.

Another object of the present invention is to provide a stop mechanism for a door which is usable on doors found in edifices as well as doors found in vehicles.

The invention possesses other objects and advantages especially as concerns particular characteristics and features thereof which will become apparent as the specification continues.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments thereof which should be taken with the prior described drawings.

Figure 1:
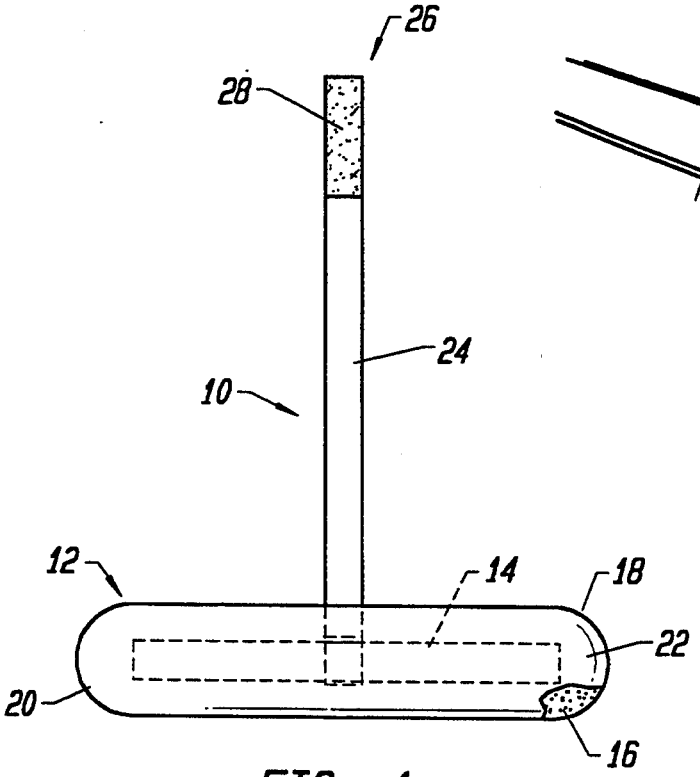
FIG. 1 is a side elevation view of the mechanism of the present invention.
Figure 3:
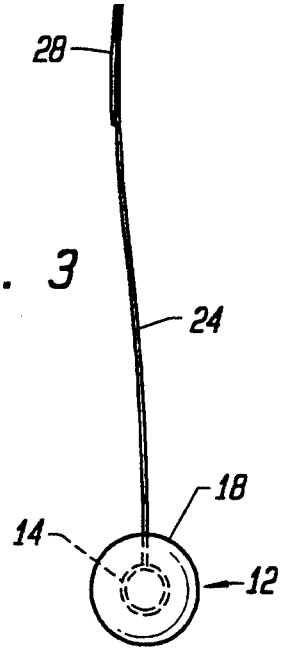
FIG. 3 is a side elevational view of the mechanism of the present invention depicting in FIG. 1.

The invention as a whole is shown in the drawings by reference character 10. The stop mechanism 10 includes as one of its elements an arresting element 12. Arresting element 12 is formed with a rigid core 14 surrounded by a relatively soft cover 16, such as foam rubber and the like. Case 18 encloses cover 16 and core 14, FIGS. 1 and 3. Arresting element 12 is approximately cylindrical in shape and includes rounded ends 20 and 22. Arresting 12 is connected to tether 24 which is formed as a ribbon or flattened band. Tether 24 includes support means 26 which is a hook or pile portion 28 of Velcro material.

Figure 2:
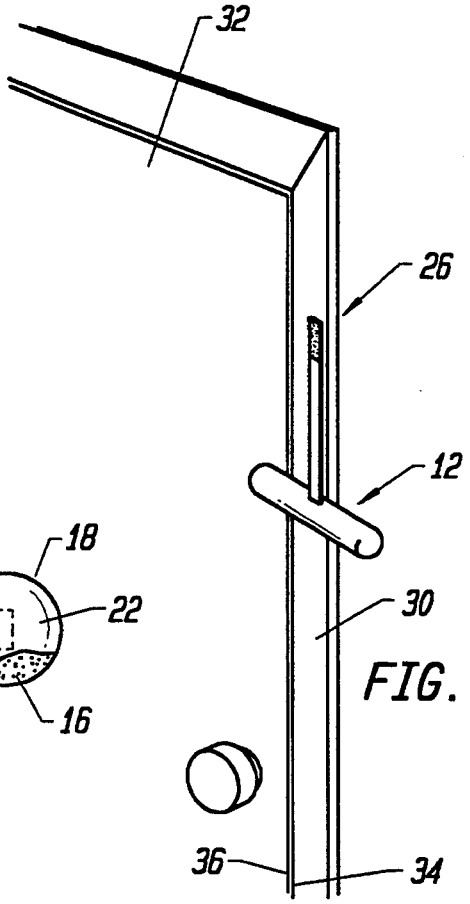
FIG. 2 is a top right perspective view of the stop mechanism of the present invention installed on a jamb associated with a door.

With reference to FIG. 2, it may be observed that support means 26 holds mechanism 10 to door jamb 30 associated with door 32. In such a position, arresting element 12 lies against door 32 and jamb 30 overlaps the edges 34 and 36 of jamb and door, respectively. The positioning of mechanism 10 as depicted in FIG. 2 will be further described hereinafter.

Figure 4:
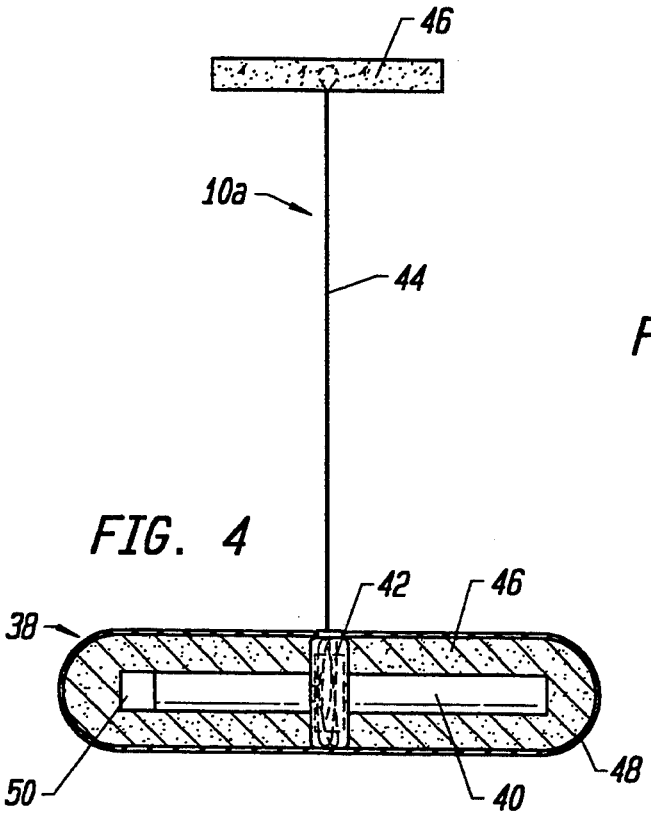
FIG. 4 is a front elevational view of another embodiment of the present invention showing the arresting element in section.

Turning now to FIG. 4, it may be observed that another embodiment 10A of the mechanism of the present invention is depicted. The mechanism 10A includes an arresting member 38 having a core 40 of relatively rigid material such as wood, plastic metal and the like. Retractable reel 42, which is spring loaded, maintains a constant tension on line 44. Line 44 may be formed of resilient or non-resilient material. Line 44 serves as a tether and is connected to support strip 46 which, again, may be a hook or pile portion of a Velcro closure material. Core 40 is surrounded by a foam rubber material serving as a cover 46 for core 40. Casing 48, similar to casing 18, encloses core 40, reel 42, and cover 46. An audible alarm 50, shown schematically in FIG. 4, such as a bell, buzzer, and the like may also be included with core 40 to sound any movement of arresting element 12.

Figure 5:
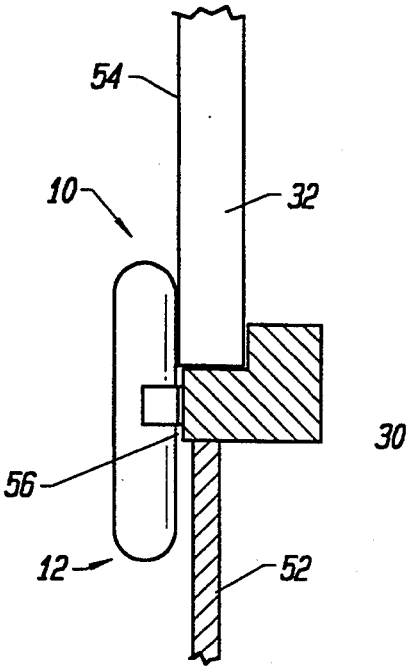
FIG. 5 is a top plan schematic view showing the embodiment of FIG. 1 in place against a closed door.
Figure 6:
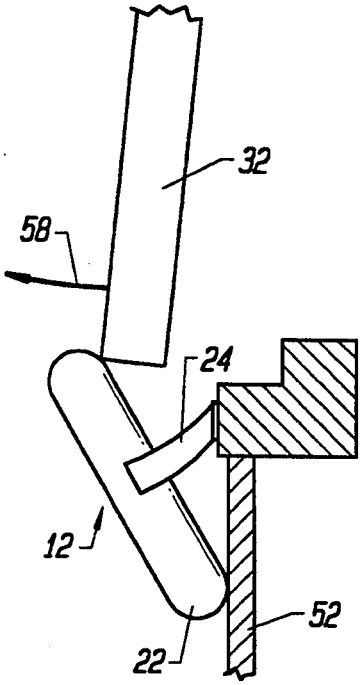
FIG. 6 is a top plan schematic view of the embodiment of the invention depicted in FIG. 1 being pushed aside by an opening door.
Figure 7:
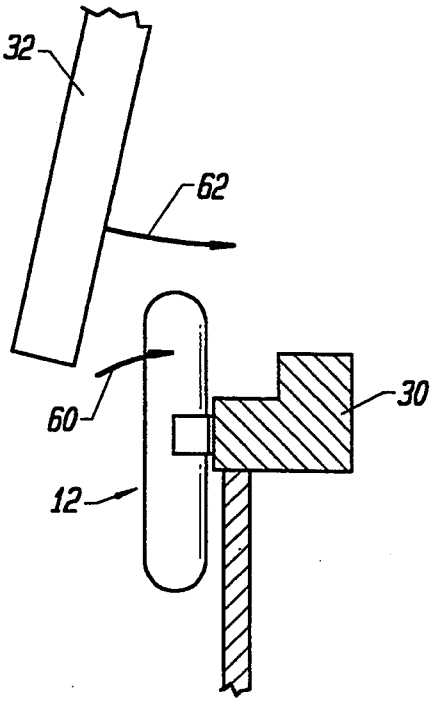
FIG. 7 is a top plan schematic view of the mechanism of the present invention of FIG. 1 moving into a position between the closing door and a jamb.
Figure 8:
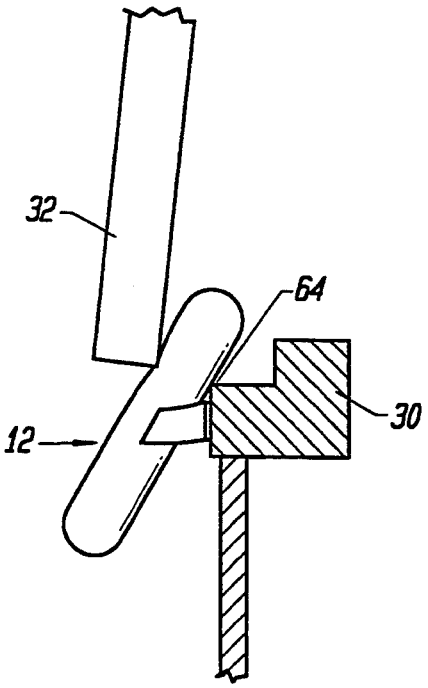
FIG. 8 is a top plan schematic view of the mechanism of the present invention of FIG. 1 holding a door open away from a jamb.

In operation, reference is made to FIGS. 5–8 in which mechanism 10 is depicted with closed door 32 and door jamb 30, which is an extension of wall member 52. In certain cases door 32 and jamb 30 may represent a vehicle door. In the first position, mechanism 10 is fastened to jamb 30 by support means 26, which may be a velcro hook or pile closure material. Arresting member 12 lies against the outer surface 54 of door 32 and outer surface 56 of door jamb 30. With reference to FIG. 5, it may be observed that the rotational opening movement of door 32, directional arrow 58, pushes aside or flips arresting member 12 outwardly into a position such that end 22 rests against wall 52 while the remaining portion of arresting member 12 touches the edge of door 32. FIG. 7 indicates that door 32 has been moved a certain distance further from that depicted in FIG. 6. Arresting member 12 then returns to the position shown in FIG. 5, directional arrow 60. The closing of door 32, directional arrow 62 finds arresting element 12 positioned between door 32 and jamb 30. FIG. 8 depicts the function of arresting member 12 interrupting the closing of door 32 relative to door jamb 30 leaving a gap 64 which is approximately of the diameter or width of arresting member 12. It should be understood, that arresting element 12 may be formed in other shapes such as the shape of a football, a soccer ball, a banana, and the like, as long as resting element 12 is capable of interrupting the closing of door 32 relative to door jamb 30 as shown in the drawings. Reel 42, FIG. 4, permits tether 44 in embodiment 10A to be positioned along door jamb 30. Also, audible alarm 50, FIG. 4, is activated upon movement of arresting member 38 and indicates the opening of door 32, which may be important where a child is the person using door 32.

While in foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A stop mechanism for a door associated with a jamb comprising:

a. an arresting element capable of withstanding force asserted on an object positioned between the closing door and the jamb;

b. a tether, said arresting element being connected to said tether, said tether holding said arresting element in a first position in the vicinity of the closed door and associated jamb such that said connected arresting element permits opening of the closed door yet prevents complete closing of the door in a second position where said arresting element is interjected between the door and the jamb;

c. support means for mounting said tether and connected arresting element to the vicinity of the door jamb; and d. a spring loaded reel connected said tether, said reel being capable of extending and retracting said tether.

2. The stop mechanism of claim 1 in which said arresting element is an elongated member, said elongated member extending across portions of the jamb and door simultaneously in said first position.

3. The stop mechanism of claim 1 in which said arresting member is formed of resilient material.

4. The stop mechanism of claim 1 in which said support means included a fastener detachable fixed to the door jamb.

5. The stop mechanism of claim 4 in which said fastener comprises a hook and pile fastener.

6. The stop mechanism of claim 1 in which said tether is a flexible line.

7. A stop mechanism for a door associated with a jamb comprising:

a. an arresting element capable of withstanding force asserted on an object positioned between the closing door and the door jamb, said arresting element including a relatively rigid core member and a force absorbing cover about said core member;

b. a tether, said arresting element being connected to said tether, said tether holding said arresting element in a first position in the vicinity of the closed door and associated jamb such that said connected arresting element permits opening of the closed door yet prevents complete closing of the door in a second position where said arresting element is interjected between the door and the jamb;

c. support means for mounting said tether and connected arresting element to the vicinity of the door jamb; and d. a spring loaded reel capable of extending and retracting said tether; said reel being attached to said core and being surrounded by said cover.

* * * * *